United States Patent [19]

Rudloff

[11] 4,123,211

[45] Oct. 31, 1978

[54] APPARATUS FOR MAKING A BONDED FELT WEB

[76] Inventor: Bernard Rudloff, 30, avenue Charles de Gaulle, Ribeauville (Haut-Rhin), France

[21] Appl. No.: 700,348

[22] Filed: Jun. 28, 1976

[30] Foreign Application Priority Data

Jun. 30, 1975 [FR] France ..... 75 21619

[51] Int. Cl.[2] ..... B29C 13/00; D04H 1/60

[52] U.S. Cl. ..... 425/82.1; 425/83.1

[58] Field of Search ..... 425/83, 81, 82, 80; 19/156.3, 156, 304, 299

[56] References Cited

U.S. PATENT DOCUMENTS

| | | | |
|---|---|---|---|
| 1,126,161 | 1/1915 | Edgecomb | 425/83 |
| 1,239,894 | 9/1917 | Edgecomb | 425/83 X |
| 3,671,210 | 6/1972 | Richardson | 425/83 X |
| 4,025,254 | 5/1977 | Arnold | 425/81 |

*Primary Examiner*—Robert L. Spicer, Jr.
*Attorney, Agent, or Firm*—Young & Thompson

[57] ABSTRACT

The disclosure is of apparatus for making a bonded felt web, wherein fibre flocks are carded and the separated fibres are mixed with powdered bonding agent and floated in air at sub-atmospheric pressure, collected on a perforated conveyor, then levelled and flattened.

5 Claims, 1 Drawing Figure

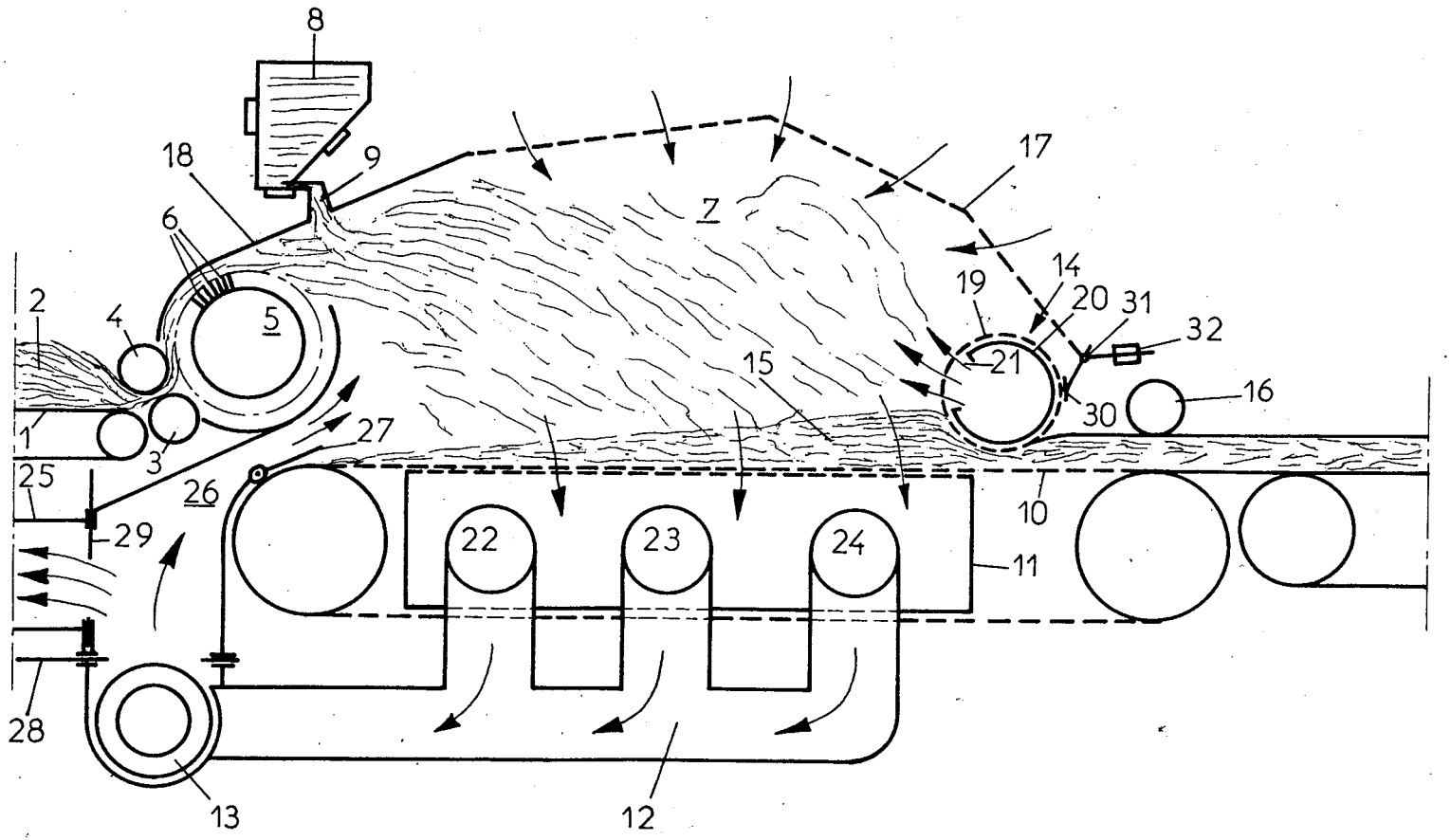
1
2
3
4
5
6
7
8
9
10
11
12
13
14
15
16
17
18
19
20
21
22
23
24
25
26
27
28
29
30
31
32

APPARATUS FOR MAKING A BONDED FELT WEB

INTRODUCTION AND BACKGROUND OF THE INVENTION

This invention relates generally to the field of the manufacture of felt webs, and is more particularly directed to apparatus for making bonded felt webs, the apparatus being suitable for putting the method into practice.

Techniques which are already known for making sheets or webs of fibres agglomerated by bonding use materials specially adapted in view of the nature of the fibres to be utilised, taking note in particular of the fineness, of the length, of the dynamometric resistance, and of the elasticity. There are thus employed, especially, carded webs in a vast range of varieties of non-woven or felt textiles, of which the fibres are bonded, either by means of liquid or pulverulent bonding agents acting under the effect of heat, or by the intervention or mechanical means, such as those which work for the trapping and in view of the interlacing of the fibres. Sometimes the two methods are put into practice together in order to obtain the desired resilience.

The present invention has as one object to mitigate some of the disadvantages of the processes described above, and has as another object to provide apparatus for making non-woven webs which allow the utilisation of fibres of all kinds and characteristics, which may be treated separately or in mixtures.

BRIEF SUMMARY OF THE INVENTION

The method performed by the apparatus according to the invention essentially comprises the steps of depositing a layer of fibres in the form of flocks upon a feeding support, passing this layer between two fluted rollers, then carding the said layer by means of a drum furnished with points or saw teeth, or the like. Following this carding operation the separated fibres are recovered in a chamber where they are mixed intimately with fine pulverulent resins. The mixture of fibres and resins is maintained in suspension in air in the chamber during the lapse of a period of time which is regulatable by virtue of a circulation of air in the chamber. This circulation of air puts the interior of the mixing chamber under a sub-atmospheric pressure and deposits the fibres mixed with resin upon a perforated support. The wadding layer thus constituted is then levelled in respect of its thickness then compressed, and finally transported towards positions for subsequent treatment.

FURTHER DESCRIPTION AND ADVANTAGES OF THE INVENTION

According to an optional feature of the invention there may equally be provided in addition to the fibres, before or after their mixing with the bonding resin, charges of heavy powders such as sulphate of baryta, micas, bitumens, etc.

The invention has also as an object the provision of an apparatus for putting into practice the method described above, constituted essentially by a feeding device, by two fluted rollers, by a carding drum, by a mixing chamber, by a device for sprinkling resins supplied to the mixing chamber through a channel, by a collecting device which is perforated and forms the lower part of the mixing chamber, by a suction chest disposed below the collecting device and connected through the intermediary of a duct to a fan, by a device for equalising the thickness of the non-woven layer, and finally by a flattening roller.

According to one feature of the invention the upper part of the mixing chamber is closed, over a portion of its length, by a perforated metal plate.

According to another feature of the invention the device for equalising the thickness comprises a perforated drum and a segment of a cylinder mounted co-axially within this perforated drum, this segment being regulatable in such a manner as to present its opening at a distance which is more or less great from the perforated collecting device.

The invention may be well comprehended with the aid of the following description with reference to a preferred embodiment, given by way of non-limitative example and explained with reference to the accompanying schematic drawing.

BRIEF DESCRIPTION OF THE VIEW IN THE DRAWING

The single view in the accompanying drawing is a schematic longitudinal sectional elevation of an apparatus according to the invention.

DETAILED DESCRIPTION OF THE PREFERRED EMBODIMENT

In conformity with the invention and as shown in the accompanying drawing, the apparatus of the invention is constituted essentially by a perforated feed conveyor 1 on which is disposed a layer 2 of fibres in the form of flocks, by two fluted rollers 3 and 4, by a carding drum 5 provided with points 6 or saw teeth or the like and adapted to feed the separated fibres into a mixing chamber 7. The latter is provided in its upper part with a sprinkler 8 whereby resins are fed into the mixing chamber 7 through a channel 9. The lower part of the mixing chamber 7 is closed by a perforated collecting conveyor 10, underneath which is disposed a suction chest 11 which is connected through the intermediary of a duct 12 to a suction fan 13. At the end of the mixing chamber 7 remote from the carding drum 5 there is provided a levelling device 14 for equalising the thickness of the resulting wadding layer 15, and downstream of this device 14 there is a flattening roller 16.

The upper part of the mixing chamber 7, between the zone adjacent to the sprinkler 8 for supplying resin and the levelling device 14 for equalising the thickness, is closed by a perforated metal plate 17 permitting the entry of air into the said chamber 7, and the portion remaining between the perforated metal plate 17 and the fluted roller 4 is formed by a plain metal plate 18 delimiting a narrow archway above the carding drum 5.

The levelling device 14 for equalising the thickness of the wadding roller 15 is constituted by a perforated drum 19 in which is disposed co-axially a cylindrical segment 20 having an opening 21, this segment 20 being regulatable in such a manner as to present its opening 21 at a more or less great distance from the perforated collecting conveyor 10.

The suction chest 11 is provided with openings 22 and 23 and 24, which are in communication with the duct 12 connected to the fan 13, permitting a regular suction over the whole surface of the perforated collecting conveyor 10 passing above the suction chest 11.

The fan 13 withdraws the air sucked into the chamber 7 and expels it partially through a duct 25 connected to a second suction fan (not shown) which returns the air to the atmosphere directly or through a filtering installation. Another portion of the air leaving the fan 13 is expelled through a channel 26, of which the outlet opening is regulatable by means of a flap 27 and which feeds this air into the chamber 7.

The degree of vacuum in the chamber 7 and the period of suspension therein of the mixture of fibres and resins are regulated by changing the performance of the fan 13 by means of draught registers 28 and 29, disposed respectively at the discharge from the fan 13 and in front of the duct 25.

The closing of the chamber 7 at the level of the levelling device 14 is effected by means of a flap 30 articulated at a pivot point 31 upon the upper part of the chamber 7, and urged against the perforated drum 19 by means of a counterpoise 32.

The illustrated apparatus for making non-woven webs in conformity with the invention functions in the following manner: The feed conveyor 1, carrying a layer 2 of fibres in the form of flocks, feeds these fibres between the two rollers 3 and 4, the latter pressing the fibres in the direction of the roller 3, both of these rollers being fluted. At the exit from between the rollers 3 and 4 the layer 2 is seized by the points 6 of the carding drum 5, which rotates at a tangential speed, preferably regulatable, between 600 and 2500 meters per minute, and which projects the separated fibres through the narrow archway formed below the plain metal plate 18 and into the mixing chamber 7. In this latter the fibres come into contact with resins dispersing from the channel 9 of the sprinkler 8, and the resins and fibres become intimately mixed. This mixture of fibres and resins remains in suspension during a period which is regulatable by action upon the suction arrangement with the aid of the draught registers 28 and 29, which allows regulation of the degree of vacuum prevailing in the interior of the chamber 7. As the metal sheet 17 is perforated it allows a circulation of the air in the direction from the ambient atmosphere into the chamber 7, and thus maintains the degree of vacuum substantially constant. The removal of the air by the fan 13, through the duct 12, is effected with the aid of the suction chest 11 disposed underneath the perforated collecting conveyor 10 and connected to the duct 12 by the openings 22 and 23 and 24. The air extracted through these openings is partially returned through the channel 26 into the chamber 7, the excess of the volume of air passing by the fan 13 being extracted by a second suction fan (not shown) at the exit from the duct 25.

The fibres coated with resin are deposited, under the effect of the suction which exists above the suction chest 11, upon the perforated conveyor 10 and accumulate there progressively. The wadding layer 15 thus constituted, of which the thickness and the weight per square meter are regulatable, either by action upon the linear speed of the conveyor 10 with a constant rate of feed to the drum 5, or with a constant speed of the conveyor 10 by action upon the rate of feed upstream of the drum 5, arrives in front of the levelling device for equalisation of the thickness. This device 14 has for its object to even out any irregularities in the thickness of the wadding layer 15, and to determine the final thickness of the felt to be obtained as well as its weight per square meter. Thus any fibres which are at a level above the opening 21 of the cylindrical segment 20 are recirculated by a circulation of air within the chamber 7. The wadding layer 15 is then compressed by the perforated drum 19 and is then flattened by the roller 16 and leaves the felt-making apparatus in order to be transported towards stations for subsequent treatment.

According to another optional feature of the invention there may be added at the upstream or downstream side of the bonding resin sprinkler 8 one or more devices for dispensing charges of heavy powders such as, for example, sulphates of baryta, micas, bitumens, etc.

The apparatus in conformity with the invention can easily be introduced into a manufacturing installation without involving great cost, and it permits the treatment of fibres of all kinds and of textile or animal or vegetable or mineral origins, whatever their inherent characteristics may be.

Moreover, with the apparatus of the invention, a very large linear production is possible, for example of the order of 15 to 20 metres per minute; as the fibres become deposited in all directions and relative orientations there can be obtained dynamometric resistances which are equal in all directions; because the mixing process is slow and efficient there can be achieved an important economy in the use of bonding resins, and the density of the felts can be varied within a wide range, for example between 5 and 80 kg/m$^3$.

Modifications are possible within the scope of the invention as defined in the following claims, notably with regard to the constitution of the various components of the apparatus.

What is claimed is:

1. An apparatus for making non-woven webs comprising a feeding conveyor, a pair of fluted rollers to which fibres are fed by said feeding conveyor, a device for separating said fibres supplied thereto from between said fluted rollers, a mixing chamber receiving the separated fibres from said device, a sprinkling device for sprinkling powdered bonding resins into said mixing chamber through a channel, a perforated collecting conveyor forming the lower part of said mixing chamber, a suction chest disposed below an operative portion of said collecting conveyor, a duct leading from said suction chest, a suction fan drawing air through said duct from said suction chest, a levelling device for equalising the thickness of the wadding layer formed by said fibres deposited upon said collecting conveyor, and a flattening roller acting upon the wadding layer leaving said levelling device, the apparatus being characterised in that the device for separating the fibres is constituted by a carding drum provided with points.

2. An apparatus as claimed in claim 1, characterised in that upstream and/or downstream at the side of the sprinkler for sprinkling bonding resins there are provided dispensing devices for dispensing charges of heavy powders such as sulphates of baryta and micas and bitumens.

3. An apparatus as claimed in claim 1, characterised in that said levelling device for equalising the thickness of the wadding layer is constituted by a rotating perforated drum and a cylindrical segment disposed co-axially within said perforated drum, said segment being regulatable in a manner for presenting its opening at a selected variable distance from said perforated collecting conveyor.

4. An apparatus as claimed in claim 1, characterized in that said leveling device for equalizing the thickness of the wadding layer is constituted by a rotating perforated drum, and means within said drum for blowing air through said drum at a predeterminable distance above said perforated collecting conveyor and in a direction opposed to the direction of movement of said perforated collecting conveyor.

5. An apparatus as claimed in claim 1, characterized in that means are provided for recirculating a portion of air from said suction fan to said mixing chamber.

* * * * *